US005863099A

United States Patent [19]

Hancock

[11] Patent Number: 5,863,099

[45] Date of Patent: Jan. 26, 1999

[54] ACTUATOR FOR A CHAIR MECHANISM LOCK

[75] Inventor: William John Hancock, County Wexford, Ireland

[73] Assignee: Ashfield Engineering Company Wexford Limited, Wexford, Ireland

[21] Appl. No.: 894,406

[22] PCT Filed: Feb. 15, 1996

[86] PCT No.: PCT/IE96/00007

§ 371 Date: Aug. 15, 1997

§ 102(e) Date: Aug. 15, 1997

[87] PCT Pub. No.: WO96/25070

PCT Pub. Date: Aug. 22, 1996

[30] Foreign Application Priority Data

| | | | |
|---|---|---|---|
| Feb. 15, 1995 | [IE] | Ireland | S95 0125 |
| Mar. 6, 1995 | [IE] | Ireland | S95 0170 |
| Aug. 17, 1995 | [IE] | Ireland | S95 0621 |
| Oct. 3, 1995 | [IE] | Ireland | S95 0771 |

[51] Int. Cl.[6] ..... A47C 15/00

[52] U.S. Cl. ..... 297/374; 297/463.1

[58] Field of Search ..... 297/374, 375, 297/376, 373, 316, 354.12, 313, 300.2, 463.1

[56] References Cited

U.S. PATENT DOCUMENTS

| | | |
|---|---|---|
| 4,292,858 | 10/1981 | Lipsheild . |
| 4,636,004 | 1/1987 | Neumúller . |
| 5,356,200 | 10/1994 | Stumpf et al. . |
| 5,588,706 | 12/1996 | Neumueller et al. . |

FOREIGN PATENT DOCUMENTS

| | | |
|---|---|---|
| 0 022 225 | 1/1981 | European Pat. Off. . |
| 0 045 925 | 2/1982 | European Pat. Off. . |
| 0 160 221 | 11/1985 | European Pat. Off. . |
| 0 499 487 | 8/1992 | European Pat. Off. . |
| 776695 | 6/1957 | United Kingdom . |
| 1082123 | 9/1967 | United Kingdom . |
| 2 193 884 | 2/1988 | United Kingdom . |
| 2 292 313 | 2/1996 | United Kingdom . |
| WO90/14031 | 11/1990 | WIPO . |

*Primary Examiner*—Milton Nelson, Jr.
*Attorney, Agent, or Firm*—Jacobson, Price, Holman & Stern, PLLC

[57] ABSTRACT

An actuator for a chair mechanism lock moves locking members such as clutch leaves between an open position at which they are free to move relative to each other and a closed position at which they are pressed together. The actuator has a first arm which is connected on one side to the mechanism housing, and on the other side to a second arm. The second arm is in turn connected to the head of a bolt which engages the clutch leaves. The first arm incorporates a handle. In a relaxed position the actuator does not exert any pressure on the clutch leaves. To close the lock, the handle is pulled upwardly to bring the first and second arms over center at which they exert pressure on the clutch leaves.

16 Claims, 9 Drawing Sheets

Figure 1A:
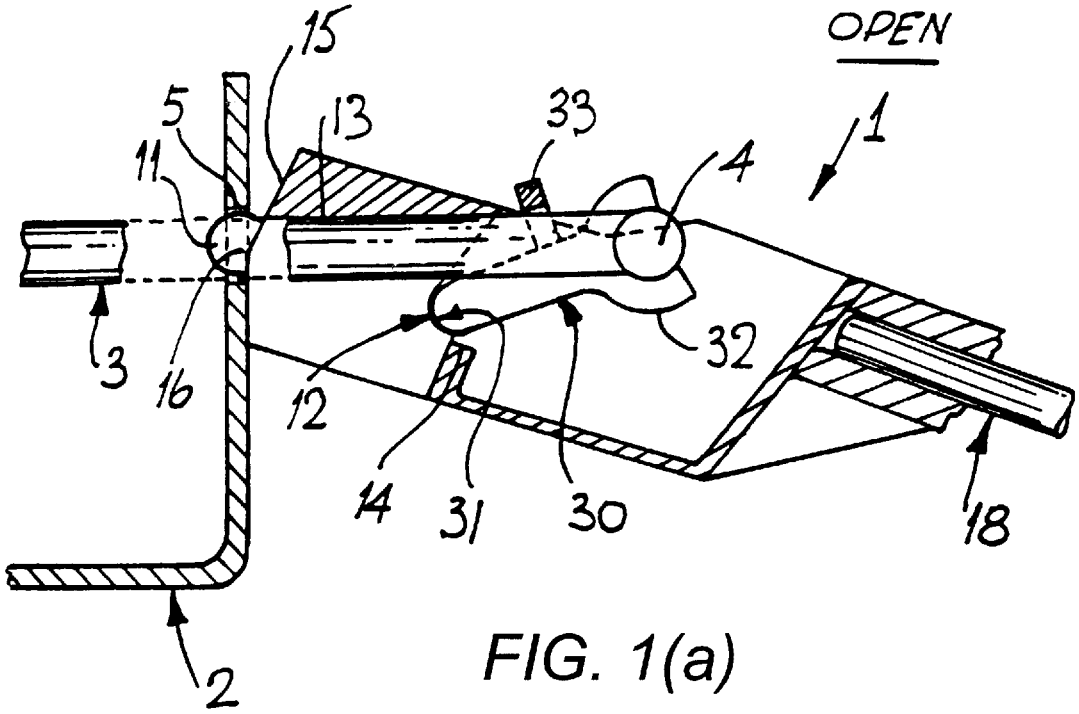

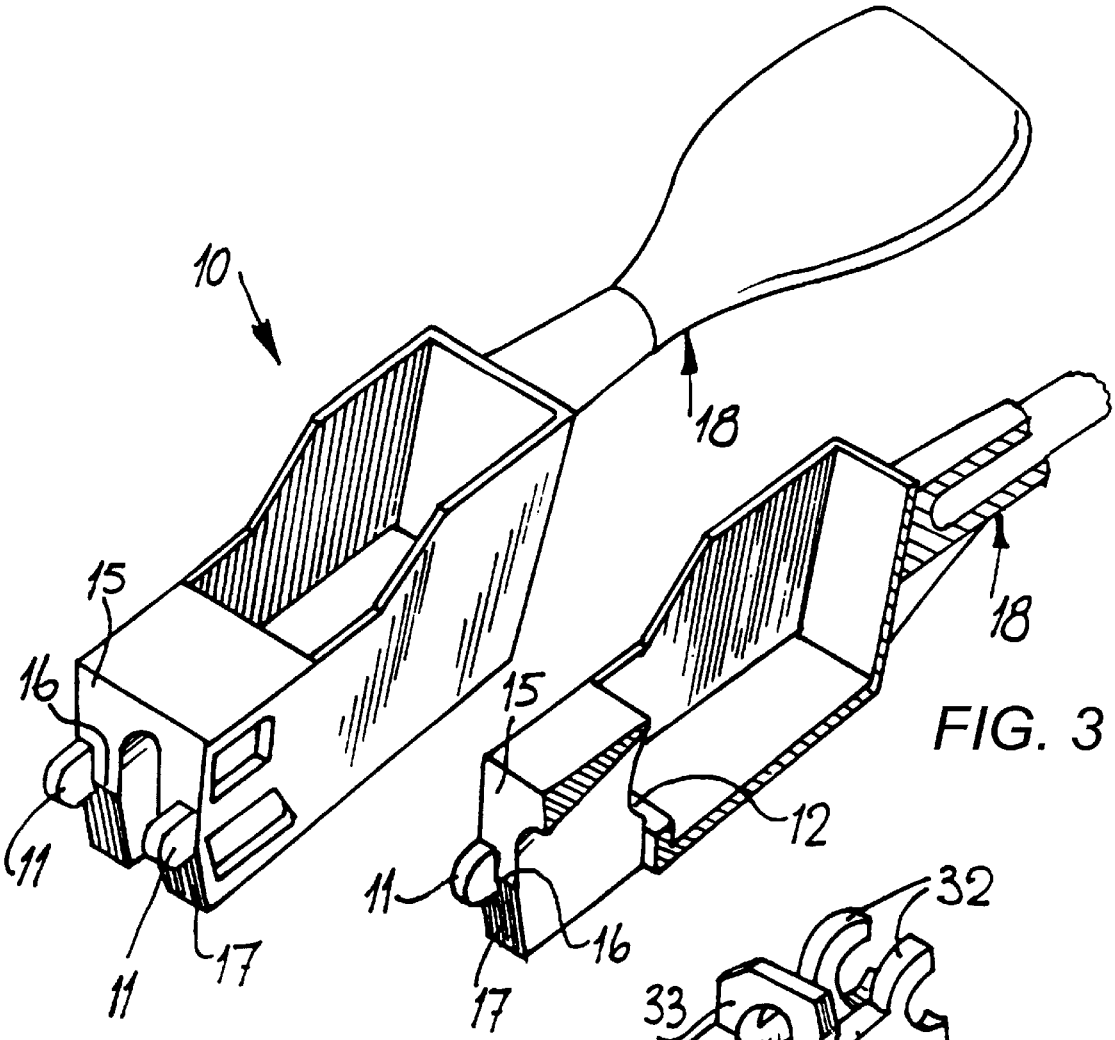
FIG. 3
FIG. 2
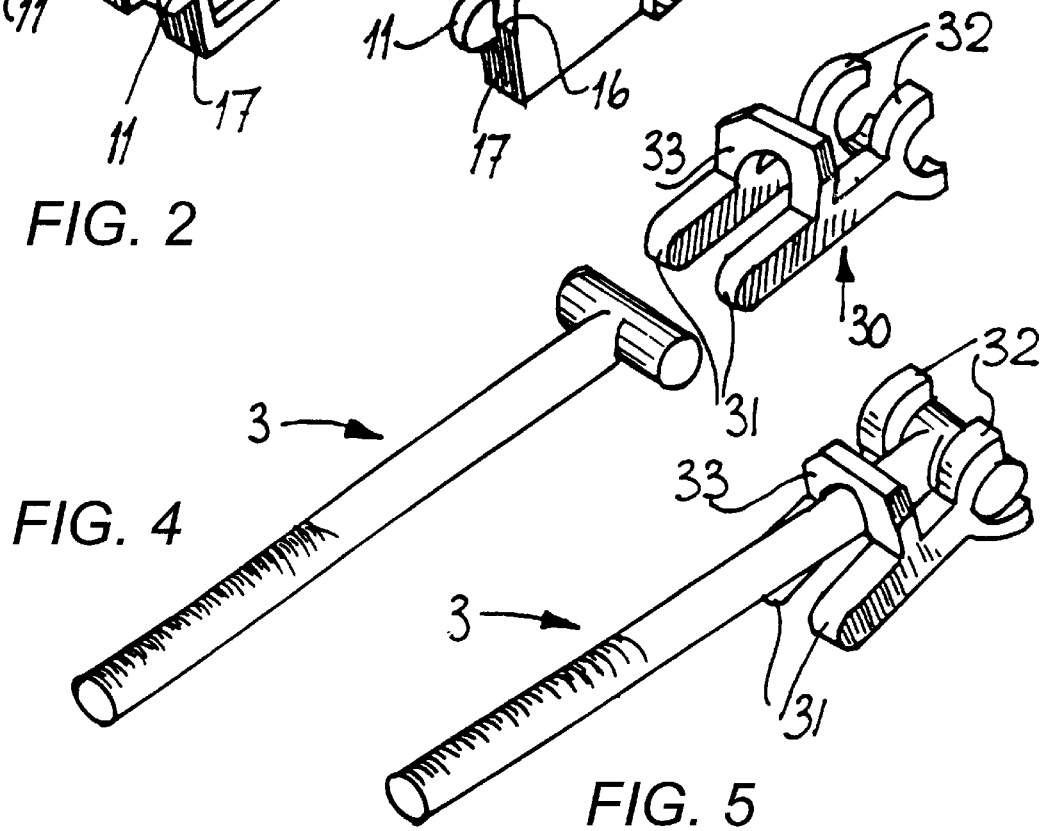
FIG. 4
FIG. 5

ACTUATOR FOR A CHAIR MECHANISM LOCK

The invention relates to an actuator for a lock of a chair adjustment mechanism of the type mounted between two mutually tiltable chair parts and in which the lock comprises at least two linearly movable locking members.

Such mechanisms have been known for a very long time. Numerous different types of lock have been provided and there has also been a wide variety of different actuators for user control of the locks. In one arrangement, the mechanism includes a gas piston to control mutual movement of parts of the chair. Such an arrangement is quite expensive and there was therefore a trend towards use of simple mechanical locks to perform this function.

The most common type of lock comprises a number of friction leaves which must be pressed together for locking. European Patent Specification No. EP160221A1 describes an actuator comprising a screw mechanism. The lock is opened and closed by rotating a handle which rotates a threaded spindle to cause the leaves to be clamped or released. A problem with such an arrangement is that the spindle may rotate a small amount to cause disengagement, especially after a prolonged period of time. Further, many people regard such actuators as being difficult to use, particularly as they must be tightened very carefully. The locking strength depends on the user's strength.

To overcome these problems actuators have been devised which are based on the principle of a spring applying pressure on the lock to provide a normally-closed lock state. For example, in GB2193884 a rod having a cam surface is acted upon by a torsion spring to clamp friction leaves together. The lock is opened by the user rotating the rod out of the clamping position. In US4636004, springs mounted within a channel-shaped mechanism housing act between a channel side wall and the friction leaves. In both of these examples, the actuator comprises a spring to exert pressure on the lock and various interconnecting elements which must be carefully positioned. This causes a high materials requirement and expensive production processes because of the difficulty in accurately mounting the various components. Another problem with these two actuators is that stresses are transmitted through the mechanism in the normally-closed position, thus possibly causing distortion over time.

In some other actuators operating according to the principle of a spring acting upon the lock for a normally-closed lock state, stresses are not transmitted through the mechanism to any great extent by in effect, pulling the lock towards a fixed wall such as a channel side wall. Examples of this type of actuator are described in EP499487A1 and EP22225. While the problem of stresses being transmitted through the mechanism is satisfactorily addressed in these actuators, these actuators still suffer from the problems of a relatively expensive materials requirement, and expensive production processes. For example, in EP499487A1, it is necessary to provide a spring, a washer and a U-shaped housing for the spring. Further, it is essential that the U-shaped bracket be accurately machined to provide a bearing for a cam which must be inserted at a fine tolerance.

In some actuators of the type having a spring acting on the lock, the user is allowed choose one of two stable positions—open and closed. In EP45925 this is achieved by a cam being rotated over-centre between a closed position at which it allows the spring to exert pressure and keep the lock closed, and an open position at which it presses against the spring to prevent it acting on the lock and allow it open. In WO90/14031 this is achieved by a pivoted arm rotating over-centre between the positions as described in relation to EP45925. While these actuators provide two stable positions, they still operate on the principle of a spring acting on the lock to exert pressure in a closed position, and a handle acting on the spring to remove the pressure in an open position. They thus suffer from the same materials and production disadvantages outlined above for the other spring-based actuators.

In summary, the approach to achieving ease of use and a consistent closing action on a lock has been to use a spring to exert pressure on the lock in the closed position, and to use other parts to remove the spring pressure in the open position. This approach has led to expensive materials requirements and production processes.

In the chair mechanism industry, it must be borne in mind that unit cost is a very important commercial factor. The business is based on producing high volumes at low margins to achieve profitability and despite this, the numerous attempts which have been made at simplifying the actuator and providing for simpler assembly have not been entirely successful. For example, while the actuator described in EP499487 represented a big improvement on previous mechanisms because it provided the lock and actuator as a combined modular unit and avoided the problems of stresses being transmitted through the mechanism, the materials requirements lead to a good deal of expense and assembly is not particularly simple. Further, the actuator may not be easily separated from the lock for sub-assembly and connection to the lock at a late stage of production.

It is therefore an object of the invention to provide an actuator for a chair mechanism which requires fewer parts than has heretofore been the case.

Another object is that the actuator may be produced in a simpler manner and may be connected to the rest of the mechanism in a simpler manner.

According to the invention, there is provided an actuator for a lock of a chair adjustment mechanism of the type mounted between two mutually tiltable chair parts and in which the lock comprises at least two linearly movable locking members, the actuator comprising:

joint formed from first and second arms pivotally connected together, one end of the joint having means on the second arm for pivotal connection to the lock and the other end of the joint having means on the first arm for pivotal connection to the anchorage, the joint ends defining a joint axis; and a control means for moving the joint from an open position on one side of the joint axis with the arms mutually angled to a closed position on the other side of the joint axis with the arms nearly in-line and exerting pressure on the locking members.

Because the actuator has a joint as described which exerts pressure on the lock, there is no need for a spring and for members to act on the spring. Further, such a joint can exert very high pressures, thus providing high lock closing strength.

In this specification, the term "first" is used to denote the arm which is pivoted to the anchorage, and the term "second" to denote the arm which acts on the lock.

In one embodiment, the control means comprises means on the first arm for engaging the anchorage in the closed position to provide a line of action spaced-apart from a pivot axis between the first arm and the anchorage during movement to the closed position.

This engagement means on the first arm may be provided with little or no extra expense, but it provides the major advantage of achieving a pressure akin to that when the arms are in-line, without sacrificing stability in the closed position.

Preferably, the first arm comprises means for pivotal connection to a chair mechanism housing. The housing provides a convenient and rigid anchorage. Preferably, the first arm comprises a lug for insertion in a socket of a chair mechanism. This allows very easy connection of the actuator to a mechanism.

In one embodiment, the control means comprises a levered handle. The resulting mechanical advantage allows the user apply a large force on the joint with little effort.

Preferably, the handle comprises a member extending from an arm. This is a very simple arrangement and allows the actuator have as few as two parts.

In the latter embodiment, the handle may comprise a member extending from the first arm. This allows the anchorage (such as the housing) provide a pivot for the handle.

In another embodiment, the first arm extends around the second arm, and the second arm engagement means comprises means for indirectly engaging locking members of a lock. This allows the actuator to be easily mounted outside the mechanism.

Preferably, the second arm engagement arm comprises means for engaging a bolt head extending from a mechanism housing. This allows the bolt (which is part of the lock) to hold the actuator in place without the need for additional supports.

In one embodiment, the actuator further comprises an adaptor for mounting between the second arm and a bolt head. This allows a large degree of versatility.

In another embodiment, the control means comprises a resilient catch mounted between the arms to help prevent accidental opening. In a further embodiment, the control means comprises a spring means mounted between the two arms to cause automatic movement to the closed position after release by the user. These features are simply implemented and provide improved safety and ease of use.

According to another aspect, the invention provides an actuator for a lock of a chair adjustment mechanism of the type mounted between two mutually tiltable chair parts and in which the lock comprises at least two linearly movable locking members, the actuator comprising:

joint formed from first and second arms pivotally connected together, one end of the joint having means on the second arm for pivotal connection to the lock and the other end of the joint having means on the first arm for pivotal connection to a housing of the mechanism, the joint ends defining a joint axis; and a control means for moving the joint from an open position on one side of the joint axis with the arms mutually angled to a closed position on the other side of the joint axis with the arms nearly in-line and exerting pressure on the locking members, wherein the control means comprises a levered handle extending from an arm, a stop surface on an arm for abutment with the mechanism to define the open position, and a stop surface on the first arm for pressing against the mechanism housing in the closed position to provide a line of action spaced-apart from a pivot axis between the first arm and the anchorage during movement to the closed position.

Preferably, the first arm extends around the second arm, the handle extends from the first arm, and the pivot means of the second arm comprises means for engaging a longitudinal member such as a bolt extending from the locking members.

The invention also provides a chair adjustment mechanism comprising an actuator as described above.

In one embodiment, the chair adjustment mechanism comprises a housing, a lock comprising a pair of locking members having inter-engaging teeth, and an actuator as described above.

Figure 1B:
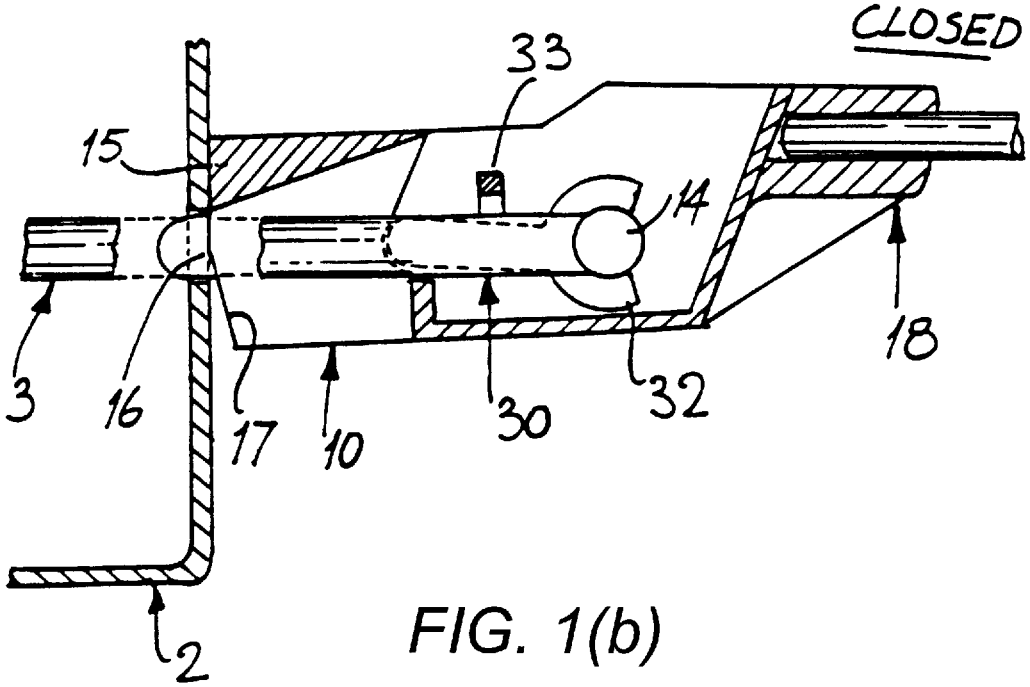
Figure 6A:
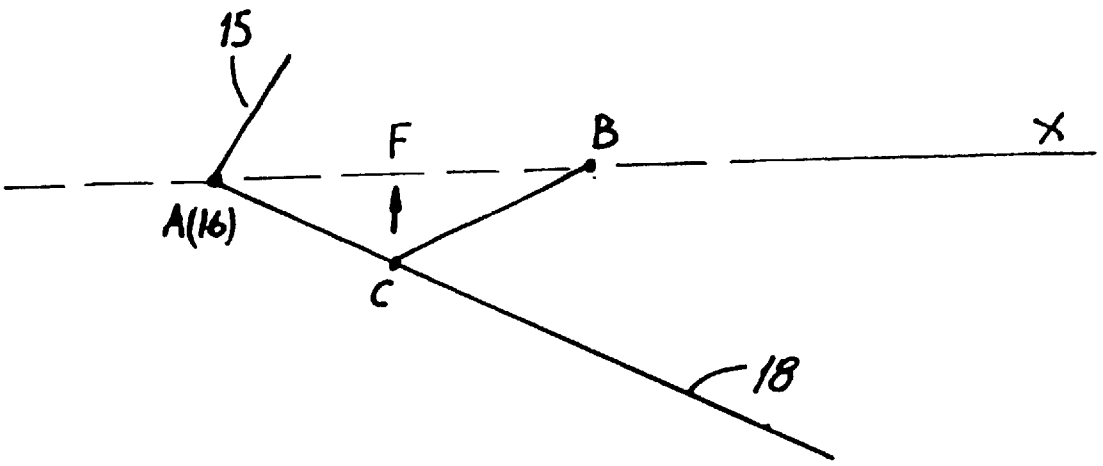
Figure 6B:
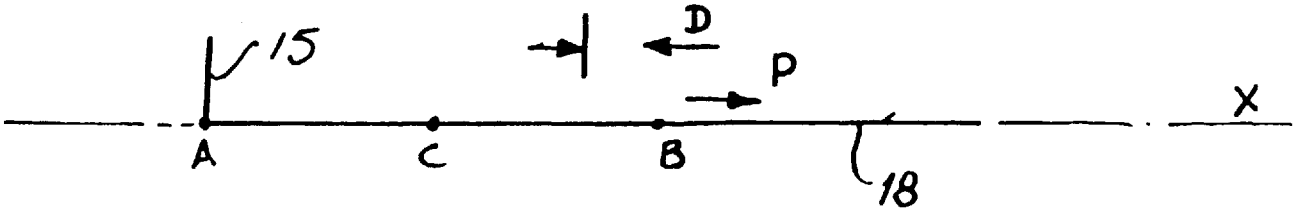
Figure 6C:
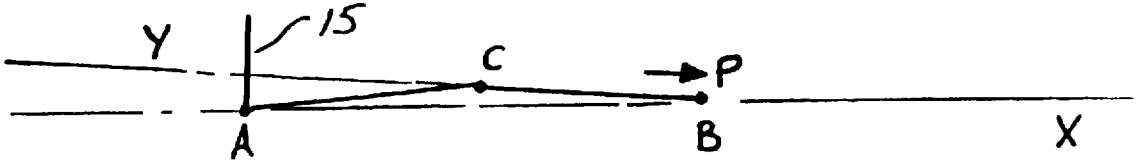
Figure 7:
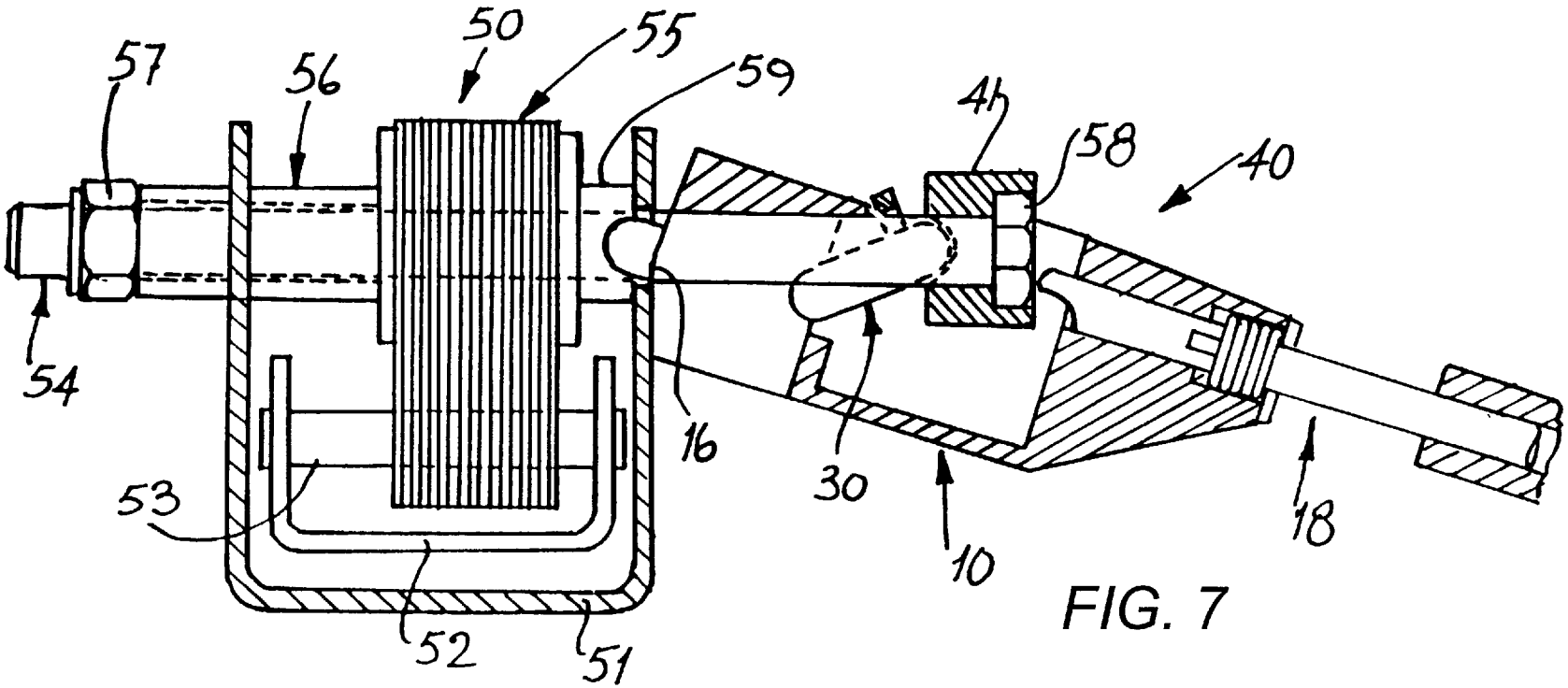
Figure 8A:
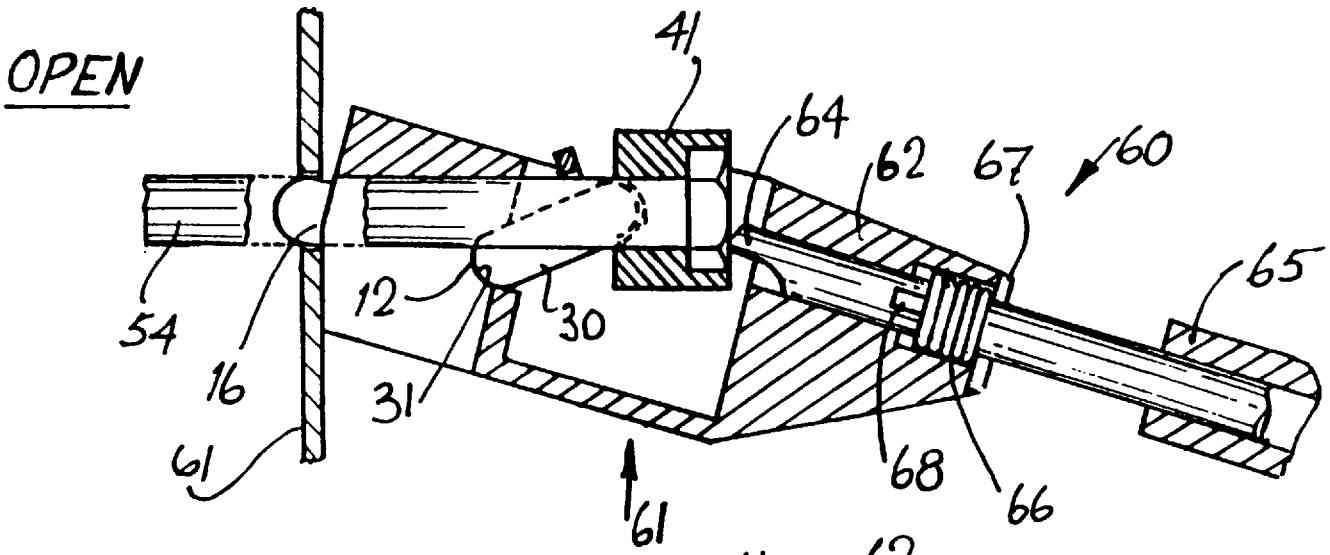
Figure 8B:
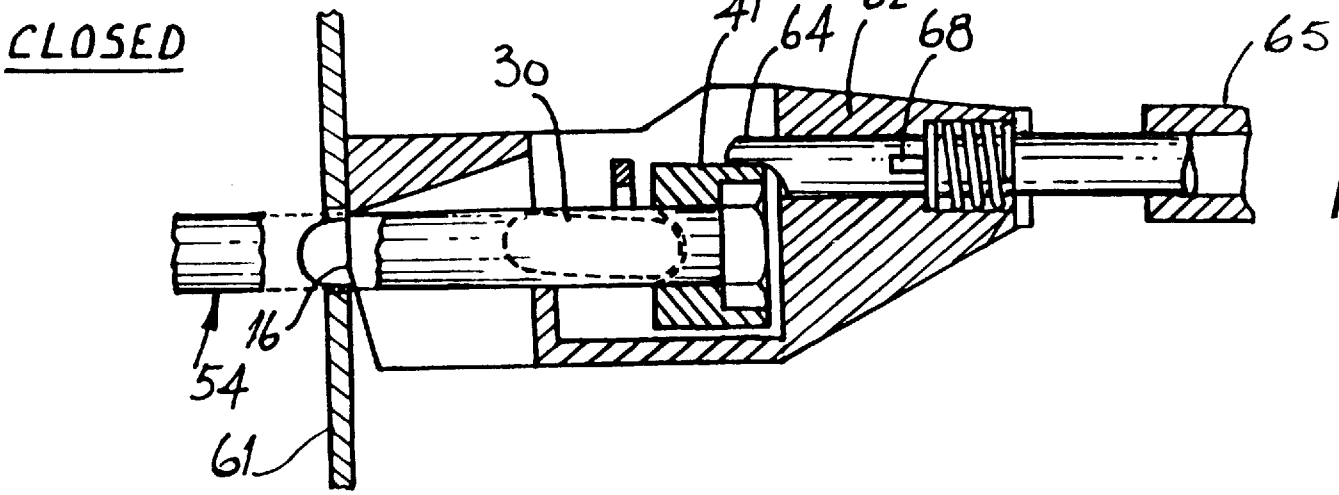
Figures 9A, 9B:
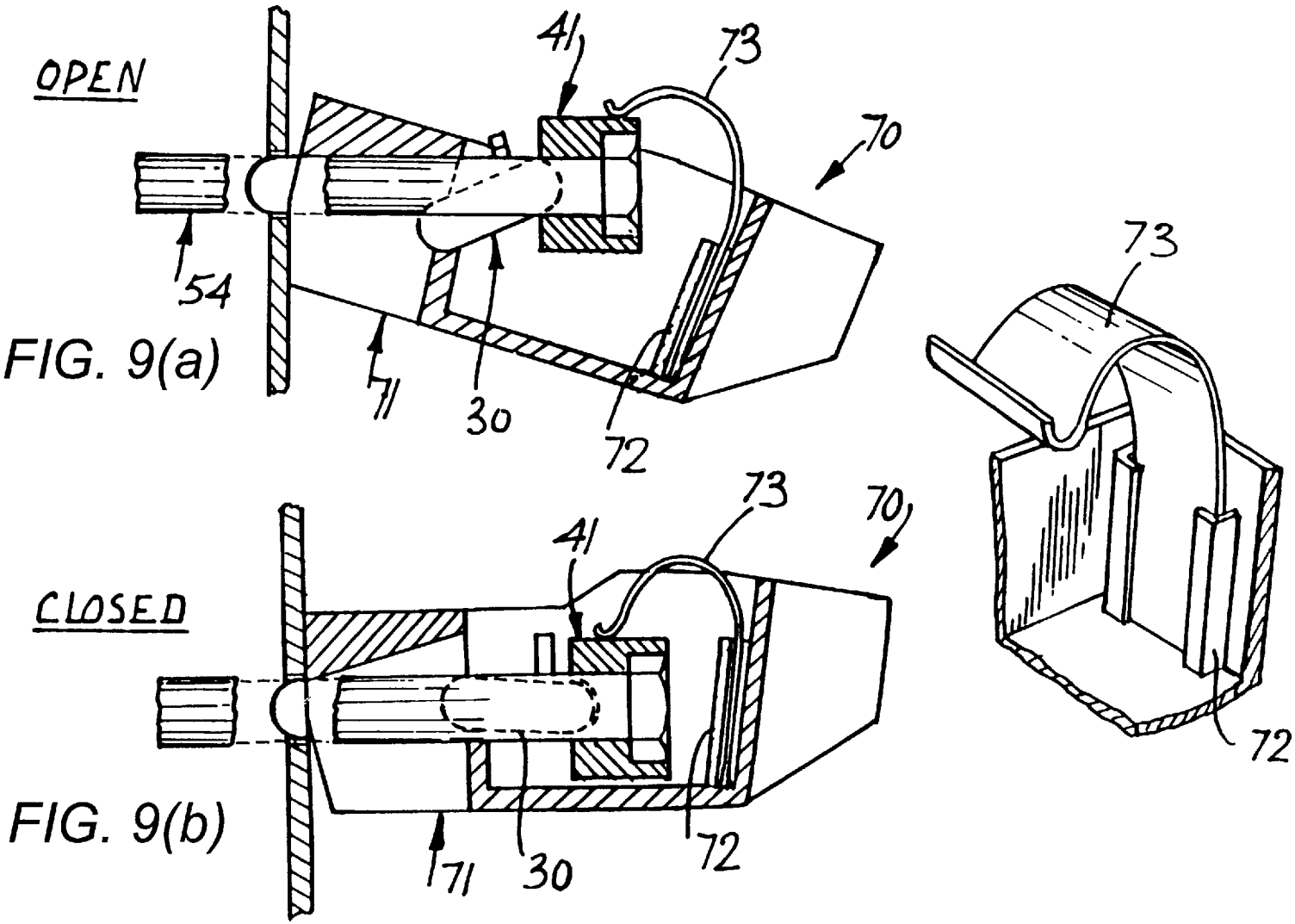
Figure 10:
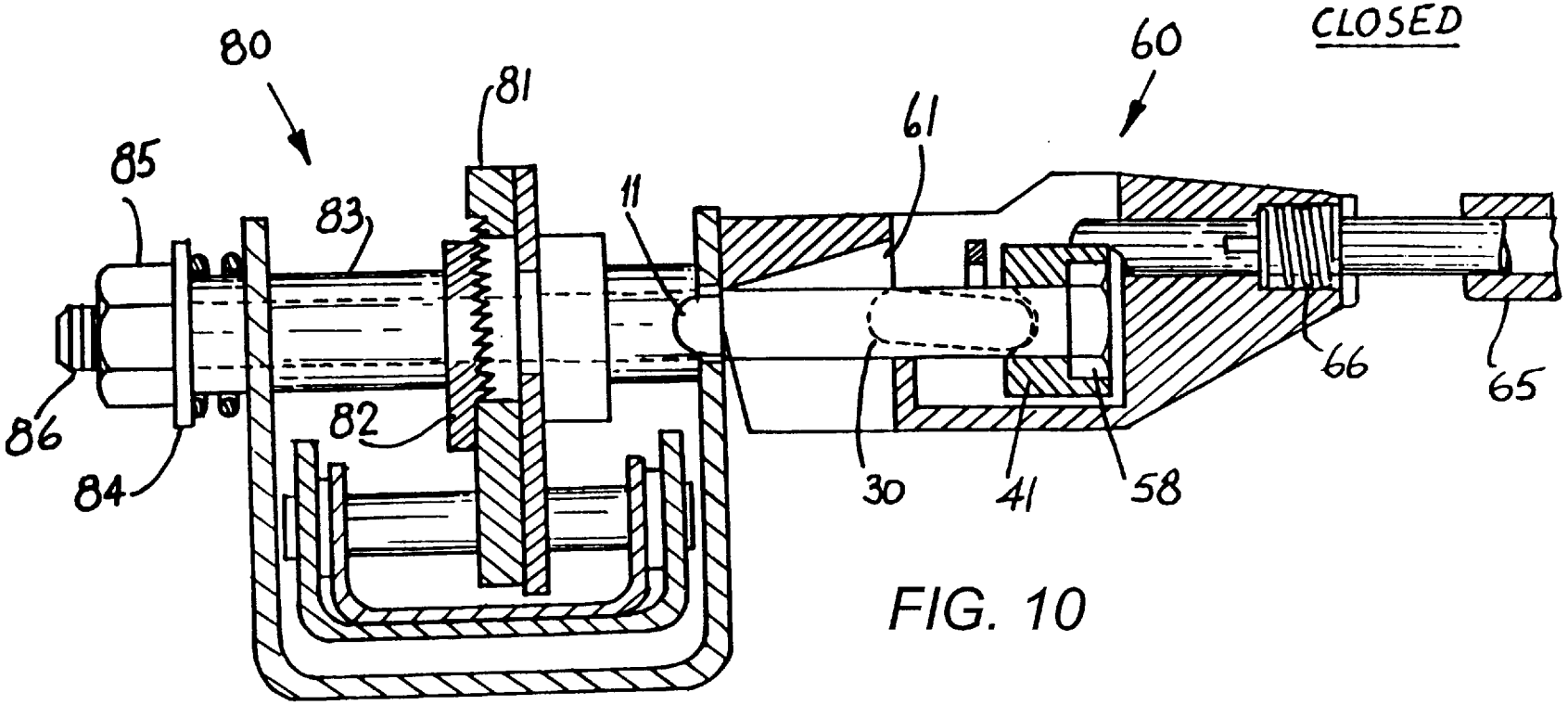
Figure 11A:
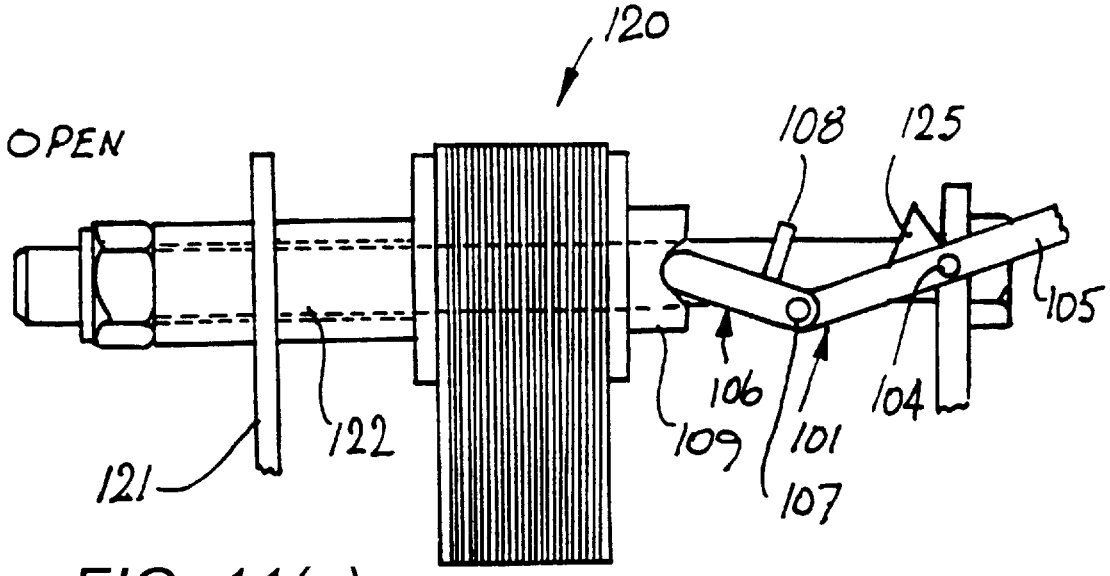
Figure 11B:
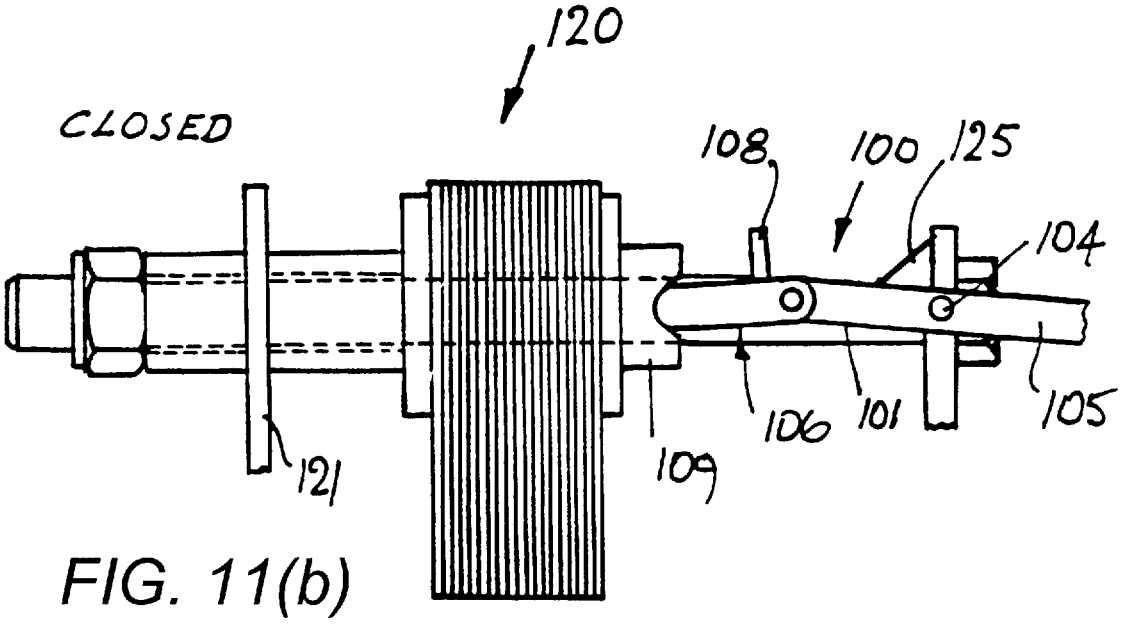
Figure 12A:
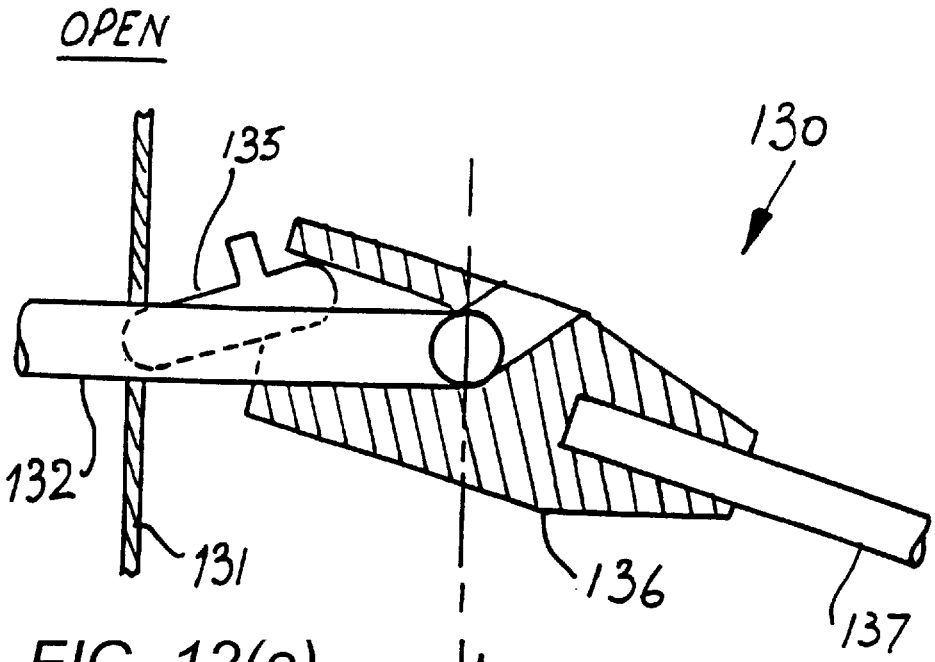
Figure 12B:
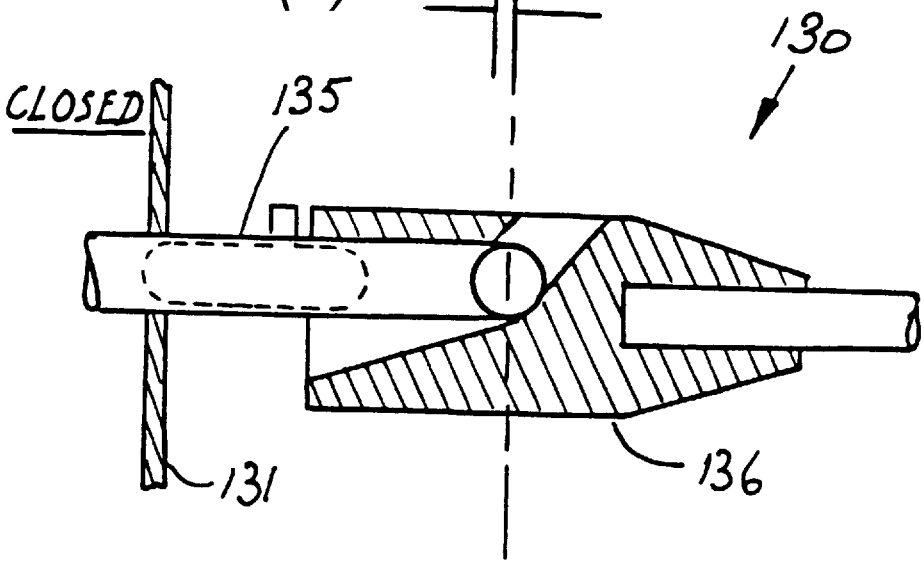

The invention will be more clearly understood from the following description of some embodiments thereof, given by way of example only with reference to the accompanying drawings in which:

FIGS. 1 (*a*) and 1(*b*) are diagrammatic cross-sectional side views showing an actuator of the invention in the open and closed positions, respectively;

FIGS. 2 to 5 inclusive are perspective views showing parts the actuator and of a lock to which it may be connected in more detail;

FIG. 6(*a*), 6(*b*) and 6(*c*) represent a set of force diagrams illustrating the principle of operation of the actuator;

FIG. 7 a diagrammatic side view showing a different actuator, connected to a mechanism having a friction-leaf lock;

FIGS. 8(*a*) and 8(*b*) are diagrammatic side views of a further construction of actuator;

FIGS. 9(*a*) and 9(*b*) are diagrammatic side views of a still further actuator;

FIG. 10 is a side view showing an actuator mounted on a mechanism which has a lock with interengaging teeth;

FIGS. 11(*a*) and 11(*b*) are views of an actuator which presses directly against a lock; and FIGS. 12(*a*) and 12(*b*) are diagrams showing a still further construction of actuator in open and closed positions.

Referring to the drawings, there is shown an actuator 1 of the invention which is shown connected to a chair mechanism having a channel-shaped housing 2. A bolt 3 having a T-shaped head 4 which is part of a lock (not shown) within the mechanism extends through the housing 2. At its inner end, the bolt 3 is connected to clamping members which clamp against locking members of the lock such as friction leaves when the bolt 3 is moved to the right as viewed in FIGS. 1(*a*) and 1(*b*).

The actuator 1 comprises a joint having a first arm 10 which is a plastics moulding. The first arm 10 comprises a pair of locating lugs 11 which together with the front faces of the arm 10 form a pivot means to allow the first arm 10 pivot about the housing 2, which forms an anchorage for the actuator 1. The first arm 10 also comprises a pair of curved seats 12 for pivotal engagement with a second arm 30 at a pair of curved ends 31. The second arm 30 comprises a pair of snap-fit sockets 32 which pivotally engage the T-shaped head 4 of the bolt 3. The actuator 1 has a handle 18 comprising an extension of the first arm 10. The ends of the joint define a joint axis.

Referring also to FIGS. 2 to 5, the first arm 10 also comprises an upper stop surface 13 and the second arm 30 has a bridging piece 33. These are for abutment with the bolt 3 in the open position as shown in FIG. 1(*a*).

At its front end the first arm 10 comprises a front face 15, a corner 16, and a tapered face 17. It also comprises a lower stop surface 14. At the closed position, the front face 15 abuts the housing 2 and the surface 14 abuts the bolt 3. They therefore define the closed position.

In operation, the actuator 1 has a stable open position shown in FIG. 1(*a*) at which the lock is open. It also has a stable closed position shown in FIG. 1(*b*) at which the lock is closed.

In the open position shown in FIG. 1(*a*), the joint formed by the arms 10 and 30 are relaxed and mutually angled with the pivot formed by the seat 12 and the end 31 at a lowermost position. In this position, the actuator does not act on the bolt 3. The bolt 3 in turn does not exert any pressure on the remaining parts of the lock (friction leaves and washers) and the lock is open. It will be noted that in the open position the bolt 3 holds the actuator in place and the surface 13 limits movement.

To reach the closed position shown in FIG. 1(*b*), the user gently pulls up the handle 18, causing the first arm 10 to pivot about the corner 16. This causes the pivot 12, 31 between the first and second arms to lift upwardly until it is in-line between the corner 16 and the centre of the bolt head 4 and the sockets 32 at which the two arms together press against the bolt head 4 to bring the bolt 3 to the furthermost right-hand-side position. When the handle 18 is lifted a very small amount further, the arms 10 and 30 move over-centre with the front face 15 against the housing 2. Therefore, the handle 18, the front face 15, and the surfaces which define the open and closed positions provide a control means to control movement of the joint formed by the arms 10 and 30.

Once the first and second arms 10 and 30 have moved over-centre, they are stable as further upward movement is limited by the face 15 and surface 14. In order to move the actuator to the open position, it is necessary for the user to press the handle 18 downwardly causing the arms to move back over-centre to the position shown in FIG. 1(*a*).

Referring now to FIG. 6, the principle of operation is shown in a simple manner with reference to force diagrams. Parts similar to those described with reference to the previous drawings are identified by the same reference numerals. Pivot A is the pivot between the first arm 10 and the housing 2 formed by the corner 16 and held in position by the lugs 11 and holes 5. Pivot B is formed by the pair of sockets 32 and the bolt head 4. Pivot C is the pivot between the first and second arms formed by the seats 12 of the first arm 10 and the ends 31 of the second arm. 30.

In the open position, the first arm 10 in this example is at an angle of 12° to the joint axis and both the arms 10 and 30 are relaxed and there is no pressure applied to the mechanism lock. Because the corner 16 is below the level of the pivot B, the joint axis X is at an angle to horizontal.

As the handle 18 is lifted up a force F is applied at the pivot C which causes pivot B to move to the right exerting a pressure P on the bolt 3. P has its highest value at the in-line position with C on the axis X as shown in the second diagram. Finally, the actuator reaches the stable over-centre closed position at which the pivot C is above the axis. Because the first arm 10 abuts against the housing 2 at the front face 15, the arms cannot move upwardly any further. At this position, the pivot B has moved a distance D to the right and exerts a pressure P against the bolt 3 to keep the lock closed.

A very important aspect is that the front face 15 presses against the housing 2, thus taking the pressure which had been applied through the corner 16 during movement to the closed position. The line of action is indicated by the interrupted line Y through B–C. Because the line of action Y is not through A, the closed position provides a level of pressure P which almost matches that as it passes through the joint axis X, without sacrificing stability. Thus the front face 15 both defines the closed position by abutment with the housing 2, but also in effect provides a fourth pivot which provides in-line pressure without in-line instability. To move to the open position, the joint must move through the joint axis X because the corner 16 takes over immediately when the arm 10 is rotated clockwise by the handle 18.

For production of a chair mechanism, the actuator 1 may be provided as a modular sub-assembly which may be connected to the rest of the mechanism at the end of the process. The rest of the mechanism is produced almost in the usual manner, the only slight differences being that the bolt 3 is provided with a T-shaped head 4 instead of a hexagonal head and the apertures 5 are made in the housing 2. Then, at the end of the production process, the first arm 10 is pushed over the bolt 3 until the lugs 11 locate within the apertures 5. The second arm 30 is then placed in position with the ends 31 engaging the seats 12, and the sockets 32 are snap-fitted onto the bolt head 4. These are the only operations which are required. The actuator 1 may then be left in the open position as shown in FIG. 1(i a) with the bolt 3 holding the actuator 1 in place.

A major advantage of the invention is the fact that the actuator requires only two parts. There is no need to provide bearings on the mechanism to support the actuator as it is supported by the holes 5 and the bolt 3.

The simple construction and production method lead to major savings in production of a chair mechanism. In one typical example, a saving of approximately $1 can be made in an actuator having an ex-works mechanism price of approximately $10 as compared to mechanisms having spring-based actuators. This makes a huge difference to commercial viability and profitability.

A further advantage of the invention is the high level of pressure which can be applied to the lock. It is well known generally that very high pressures can be applied using the toggle principle. In practice, when applied to a chair mechanism lock in this way, a much smaller friction leaf surface area can be used while achieving the same locking strength. Indeed, it has been found that the actuator of the invention provides to the user the "soft touch" associated with expensive locks having large numbers of friction leaves and a spring-based actuator, at much lower expense.

Another advantage of the invention is the fact that the major reductions in cost are achieved while also providing improved reliability. Because there is no need to locate the actuator very accurately and wear of the parts will not significantly affect its operation, it is envisaged that reliability will be considerably improved with respect to those presently available.

A still further advantage is the fact that the reduced cost is not achieved by making a trade-off against versatility of the actuator. For example, in a synchronised tilting chair mechanism, the user may have a normally-open position of the lock to allow synchronised tilting occur at any time. However, if the parts of the chair are freely interconnected and the mechanism functions to provide a desired locked position of the parts, then a normally-closed position may be used.

Another aspect of versatility of the actuator is that it may be easily retrofitted to existing mechanisms. In the above embodiments the only modifications required of a conventional mechanism are provision of the locating holes 5 in the housing side wall and provision of a T-shaped head in the lock's bolt 3. However, even less is required if the actuator includes an adaptor as shown in FIG. 7. In this embodiment an actuator 40 is shown mounted on a chair mechanism 50. The mechanism 50 comprises a seat support 51, and a fixed support 52 having a fixed pin 53. The pin 53 is connected to a lock comprising a bolt 54 extending across the seat support 51 and through clutch leaves 55. The lock also comprises a spacer 56 between the leaves 55 and a nut 57 on the bolt 54, and a spacer 59 on the other side of the leaves 55. The bolt 54 has a conventional hexagonal head 58. The actuator 40 has the same parts as the actuator 1, but additionally includes an adapter 41 connecting the second arm 30 to the hexagonal bolt head 58. The adapter 41 is a very simple moulded plastics part and adds very little to expense of materials and production. However, it provides the advantage that the only modification required of a conventional mechanism is provision of the apertures in the housing side wall, in this case the seat support 51.

Other modifications within the scope of the invention will be immediately apparent. For example, an actuator 60 is shown in FIGS. 8(*a*) and 8(*b*) in which parts similar to those described with reference to the previous drawings are indicated by the same reference numerals. The actuator 60 has a first arm 61 having a socket piece 62 receiving a slidable handle 63 terminating in a catch 64. The handle has a "paddle" 65 and is biased longitudinally to the left by a coil spring 66 acting between a shoulder 67 in the socket piece 62 and stops 68 on the handle 63. In the closed position (FIG. 8(*b*)) the catch 64 extends over the adapter 41. Therefore, the handle 63 must be pulled to the right and pushed down to open the lock. This provides additional safety in a simple manner by helping to prevent accidental opening.

Referring to FIGS. 9(*a*) and 9(*b*) an actuator 70 is shown which has the feature of automatically returning to the closed position after being opened by the user. Again, parts similar to those described with reference to the previous drawings are identified by the same reference numerals. In this embodiment, a first arm 71 has a channel-shaped socket 72 receiving the shank of a leaf spring 73. The spring 73 presses against the top of the adapter 41, causing the first arm 71 to automatically return to the closed position from the open position shown in FIG. 9(*a*).

The actuator of the invention may be used in conjunction with any chair mechanism lock which has locking members which are linearly movable. In the embodiments described the locking members are friction leaves, however, they could be members having inter-engaging teeth such as described in FIG. 10 and our co-pending European Patent Application No. EP95650029.2. In this embodiment, a chair mechanism 80 has a pair of toothed locking members 81 and 82 acted upon by a spacer 83, a washer 84, and a nut 85 on a bolt 86.

It is not essential that the actuator be mounted outside the mechanism, or that it acts indirectly on the lock members. For example, as shown in the diagram of FIGS. 11(*a*) and 11(*b*) the arms could be mounted inside the mechanism housing between a side wall and the lock whereby they push directly against the lock in the closed position. In these drawings, an actuator 100 has a first arm 101 which is pivoted to the housing 121 of a mechanism 120 at a pivot joint 104 and extends outside the mechanism to provide a handle 105. The first arm 101 is connected to a second arm 106 at a pivot 107. The second arm 106 comprises a pair of members interconnected by a bridging piece 108 and engaging a receiver 109 mounted on a bolt 122 extending across the housing 121. The actuator 100 operates according to the same principle as the other described actuators—only differing in the fact that it acts directly on the lock. The bridging piece 108 provides a limit for the open position by abutting against the bolt 122, while a first arm extension 125 defines the limit for the closed position. The first arm upwardly-directed extension 125 presses against the housing 121 to provide the same additional advantage as the front face 15 of the actuator 1.

Because of the simplicity of the actuator of the invention, numerous different variations will be immediately apparent to those skilled in the art. For example it is not essential that the control means comprises a handle incorporated in the first arm. For example, the handle could be incorporated in the second arm. Such an arrangement is shown in FIGS. 12(*a*) and 12(*b*) in an actuator 130 mounted on a mechanism having a housing 131 and a lock bolt 132. A first arm 135 is pivotally connected to the housing 131 and to a second arm 136, in turn pivotally connected to the head of the bolt 132 and having a handle 137. The first arm 135 could have a member engaging the housing 131 in the closed position to provide the same advantageous effect as the front face 15 of the actuator 1.

A handle could alternatively be mounted separately from both arms. Because very short user movement is required, the control means could include a push-button arrangement operatively connected to the arms. The important point is that the control means causes the joint to be moved between the two positions.

While provision of a handle in the form of a lever provides a large mechanical advantage and therefore requires little user effort, it is envisaged that the handle need not necessarily be in the form of a lever as it could be part of a push-pull mechanism for example. Other variations within the scope of the invention will be immediately apparent. The joint arms may be of any material which has the compression strength necessary to close the lock and could be of plastics or metal.

I claim:

1. An actuator for a lock of a chair adjustment mechanism mounted between two mutually tiltable chair parts and comprising an anchorage and in which the lock comprises at least two linearly movable locking members, the actuator comprising:

a joint formed from first and second arms pivotally connected together, one end of the joint having means on the second arm for pivotal connection to the lock and the other end of the joint having means on the first arm for pivotal connection to the anchorage, the joint ends defining a joint axis; and a control means for moving the joint from an open position on one side of the joint axis with the arms mutually angled to a closed position on the other side of the joint axis with the arms nearly in-line and exerting pressure on the locking members.

2. An actuator as claimed in claim 1, wherein the control means comprises means on the first arm for engaging the anchorage in the closed position to provide a line of action spaced-apart from a pivot axis between the first arm and the anchorage during movement to the closed position.

3. An actuator as claimed in claim 1, wherein the control means comprises a resilient catch mounted between the arms to help prevent accidental openings.

4. An actuator as claimed in claim 1 wherein the control means comprises a spring means mounted between the two arms to cause automatic movement to the closed position after release by a user.

5. A chair adjustment mechanism comprising an actuator as claimed in claim 1.

6. A chair mechanism comprising a housing, a lock comprising a pair of locking members having inter-engaging teeth, and an actuator as claimed in claim 1.

7. An actuator as claimed in claim 1, wherein the first arm comprises means for pivotal connection to a chair adjustment mechanism housing.

8. An actuator as claimed in claim 7, wherein the first arm comprises a lug for insertion in a socket of a chair adjustment mechanism.

9. An actuator as claimed in claim 1, wherein the control means comprises a levered handle.

10. An actuator as claimed in claim 9, wherein the handle comprises a member extending from one of the first arm and the second arm.

11. An actuator as claimed in claim 10, wherein the handle comprises a member extending from the first arm.

12. An actuator as claimed in claim 1, wherein the first arm extends around the second arm, and a second arm engagement means comprises means for indirectly engaging locking members of a lock.

13. An actuator as claimed in claim 12, wherein the second arm engagement means comprises means for engaging a bolt head extending from a mechanism housing.

14. An actuator as claimed in claim 12, wherein the second arm engagement means comprises an adaptor for mounting between the second arm and a bolt head extending from a mechanism housing.

15. An actuator for a lock of a chair adjustment mechanism mounted between two mutually tiltable chair parts and in which the lock comprises at least two linearly movable locking members, the actuator comprising:

a joint formed from first and second arms pivotally connected together, one end of the joint having means on the second arm for pivotal connection to the lock and the other end of the joint having means on the first arm for pivotal connection to a housing of the mechanism, the joint ends defining a joint axis; and a control means for moving the joint from an open position on one side of the joint axis with the arms mutually angled to a closed position on the other side of the joint axis with the arms nearly in-line and exerting pressure on the locking members, wherein the control means comprises a levered handle extending from an arm, a stop surface on an arm for abutment with the housing to define the open position, and a stop surface on the first arm for pressing against the mechanism housing in the closed position to provide a line of action spaced-apart from a pivot axis between the first arm and an anchorage during movement to the closed position.

16. An actuator as claimed in claim 15, wherein the first arm extends around the second arm, the handle extends from the first arm, and the pivot means of the second arm comprises means for engaging a longitudinal member extending from the locking members.

* * * * *